US012078345B2

(12) United States Patent
Kaiser et al.

(10) Patent No.: US 12,078,345 B2
(45) Date of Patent: Sep. 3, 2024

(54) FIRE COLUMN

(71) Applicants: Thomas Kaiser, Überbach (DE); Christian Wassermann, Ebenhofen (DE)

(72) Inventors: Thomas Kaiser, Überbach (DE); Christian Wassermann, Ebenhofen (DE)

( * ) Notice: Subject to any disclaimer, the term of this patent is extended or adjusted under 35 U.S.C. 154(b) by 737 days.

(21) Appl. No.: 17/278,577

(22) PCT Filed: Oct. 3, 2019

(86) PCT No.: PCT/EP2019/000284

§ 371 (c)(1),
(2) Date: Aug. 26, 2021

(87) PCT Pub. No.: WO2020/069770

PCT Pub. Date: Apr. 9, 2020

(65) Prior Publication Data

US 2022/0235930 A1 Jul. 28, 2022

(30) Foreign Application Priority Data

Oct. 4, 2018 (DE) ..... 202018004601.9

(51) Int. Cl.

| | |
|---|---|
| ***F23C 7/00*** | (2006.01) |
| ***F23B 60/02*** | (2006.01) |
| *F23C 3/00* | (2006.01) |
| *F23D 14/24* | (2006.01) |

(52) U.S. Cl.

CPC ..... *F23C 7/004* (2013.01); *F23B 60/02* (2013.01); *F23C 3/002* (2013.01); *F23C 2900/03009* (2013.01); *F23D 14/24* (2013.01)

(58) Field of Classification Search

CPC ..... F23B 60/02; F23C 7/004; F23C 2900/03009; F23C 3/002; F23D 5/02

See application file for complete search history.

(56) References Cited

U.S. PATENT DOCUMENTS

| | | | | |
|---|---|---|---|---|
| 7,097,448 | B2 | 8/2006 | Chesney | |
| 8,641,413 | B2 | 2/2014 | Chen et al. | |
| 9,170,017 | B2 * | 10/2015 | Shimek | F23C 7/004 |

(Continued)

FOREIGN PATENT DOCUMENTS

| | | |
|---|---|---|
| DE | 202007018478 U1 | 9/2008 |
| DE | 102008012794 | 8/2009 |
| DE | 102013100971 | 1/2017 |

OTHER PUBLICATIONS

International Preliminary Report on Patentability for PCT/EP2019/000284, Apr. 15, 2021.

*Primary Examiner* — Alfred Basichas
(74) *Attorney, Agent, or Firm* — Endurance Law Group PLC

(57) ABSTRACT

In order to create a safe and simply designed fire column, the flame of which is fed from a fuel tank, in particular for bioethanol, and is surrounded by an outer casing (4), wherein supply air flows in largely axially in the lower region of the outer casing via a plurality of guide elements (3) and is preferably set in helical rotation to form a swirling flame, according to the invention the outer casing (4) is placed over the guide elements (3). The outer casing (4) is preferably centered in an upright position by outer edges (3*a*) of the guide elements (3).

19 Claims, 5 Drawing Sheets

(56) References Cited

U.S. PATENT DOCUMENTS

| | | | | |
|---|---|---|---|---|
| 10,101,036 | B2 | 10/2018 | Fuller et al. | |
| 10,330,313 | B2 * | 6/2019 | Huang | F23C 7/004 |
| 2012/0178035 | A1 * | 7/2012 | Chen | F23D 5/04 431/354 |
| 2012/0231403 | A1 | 9/2012 | Chen et al. | |
| 2013/0011800 | A1 | 1/2013 | Chen | |
| 2013/0252188 | A1 * | 9/2013 | Chen | F23D 14/10 431/355 |
| 2014/0290643 | A1 | 10/2014 | Potter | |
| 2015/0167962 | A1 * | 6/2015 | Chen | F23D 3/20 431/353 |
| 2015/0167963 | A1 * | 6/2015 | Chen | F23C 7/002 431/353 |
| 2015/0167964 | A1 * | 6/2015 | Chen | F23D 3/20 431/353 |
| 2018/0051886 | A1 | 2/2018 | Myers et al. | |

* cited by examiner

FIRE COLUMN

BACKGROUND OF THE INVENTION

Field of the Invention

The invention relates to a fire column having the features of the preamble of claim 1, in particular for forming a vortex flame.

Description of Related Art

In such fire columns, usually with a glass cylinder as outer casing, the flame is set in rotation by swirled air, so that the "tornado-like" appearance results in a special optical attraction for the observers. In U.S. Pat. No. 7,097,448, this flame appearance is described as "corkscrew"-shaped. When using bio-ethanol and similar fuels, such fire or flame columns are also suitable in homes and are used primarily for decoration, but also for recreation of the inhabitants, as is often attributed to open fireplaces (or replicated fireplaces on monitors). In addition, such fire columns are used in outdoor areas, e.g. on terraces, wherein they then serve as light and heat sources on colder evenings.

A fire column of this type is known from U.S. Pat. No. 8,641,413, in which a base having the same diameter is arranged at the lower end of the glass cylinder, in which a large number of lateral blade elements are arranged in the form of helixes or helical lines. The air inflow and turbulent flame zone are clearly illustrated in FIG. 8. The glass cylinder is placed on the base (likewise in US 2014/0290643 A1) and can therefore be easily knocked over by playing children, for example. The risk of accident and injury is therefore considerable, especially as the outer casing, which begins here at the level of the combustion bowl, can become relatively hot. In US 2014/0290643, a second concentric glass cylinder was used for this purpose, but this increases the construction effort considerably.

The construction effort is also relatively high in U.S. Pat. No. 8,641,413, since the individually attached guide elements are combined with a metal ring. In addition, this guide apparatus is divided into two parts in order to gain access to the combustion bowl by swinging out one half, e.g. when lighting or extinguishing the flame. This is also due to the fact that the glass cylinder is relatively hot, so that it should only be lifted off when wearing gloves. In U.S. Pat. No. 7,097,448, the outer casing is intended to remain relatively cold due to several tangential inflow gaps, but in this case the casing is at least in two parts and thus relatively complex to manufacture or assemble.

BRIEF SUMMARY OF THE INVENTION

Thus, the invention is based on the task of improving such a fire column with regard to safety and construction effort.

This task is solved by a fire column according to claim 1. Expedient embodiments are subject of the subclaims.

The proposed placing of the outer casing over the guide elements provides a secure hold, since the inner wall of the outer casing engages around the guide elements with a small clearance fit. This axial overlap is preferably about 20% of the height of the outer casing, so that in combination with a relatively solid foot or base part, unintentional knocking over of the glass cylinder is hardly possible. Another advantage of the overlap is that the outer edges of the guide elements are enclosed by the outer casing, so that no separate component is required to delimit the individual air channels between the guide elements. The aforementioned clearance fit thus largely prevents the transfer of supply air from one air channel to the adjacent air channel, but still allows the outer casing to be lifted off easily in a vertical direction. It is advantageous here that the plurality of air channels (e.g. six in the case of six guide elements) cools the outer casing (in particular the inner wall of the glass cylinder) by an increased flow velocity, so that the lower region of the glass cylinder (and possibly the middle region at the level of the flame outlet above the fuel container) remains relatively cool. This minimizes the risk of burns and the outer casing can be removed without gloves by grasping the lower, cool region in order to extinguish the flame.

Thus, a chimney effect is created due to the thermal lift not only in the upper region of the fire column, but also in the individual air channels between the guide elements. These can also be nozzle-shaped in order to increase the flow velocity for cooling purposes. A blower or fan (as in the aforementioned prior art) is thus not required, which further reduces the construction effort and increases the usability in the garden (outdoors). In addition, the guide elements can be produced in a cost-saving manner together with the base part (incl. fuel receiver) as a cast part, wherein the guide elements can also be produced in an oblique or helical shape in one manufacturing step for the preferred formation of air vortices. In the case of axial main alignment of the guide blades, these can also be extruded together with the fuel holder in the manner of a heat sink tube, which can significantly reduce manufacturing costs (for higher quantities). Such extruded or continuously cast parts also exhibit high dimensional accuracy, which can ensure the above-mentioned clearance fit even without machining.

The generation of an air vortex rotating around the vertical axis of the fire column is particularly intensive due to the aforementioned helical air guide elements, but even with only slightly inclined blade surfaces, intensive swirling is already achieved, since the air flow which is initially axial and largely laminar becomes increasingly turbulent in the region of the flame. Even with a purely axial inflow from the lower part of the fire column, this chimney effect (with good cooling of the lower region of the inner wall of the fire column) allows swirling at the height of the flame in the manner of a flickering fire. Since the flame appearance also depends on the amount of air supplied, the lower supply air cross section (before the entrance to the guide elements) is preferably variable.

The outer casing preferably consists of refractory glass, in particular in the form of a cylinder with an open end face. Such tubes can be manufactured with high precision (to ensure the above-mentioned clearance fit) and are relatively inexpensive due to series production (e.g. for use in the chemical industry). However, other shapes and materials are also possible, e.g. a metal tube with windows in the manner of a lamp or a metal grid or metal mesh. The outer casing preferably rests at its lower end face on several radially aligned pins attached to a base part that surrounds the fuel container. The latter can also be designed for fuel paste or for receiving wood pellets or other fuels.

The base part is preferably made of metal in order to ensure the required stability together with a relatively heavy stand plate, especially in the so-called table fire version. The fire column can also be arranged in an elevated manner in order to increase the light effect, in particular with a holder in the manner of a patio heater (so-called "heating mushroom") for the terrace area or with a support, e.g. in the manner of a ground spike for the garden area. The above-mentioned pins can also be molded or attached to the respective lower end of the e.g. three guide elements, so that the number of components is further reduced. The pins may be adjustable in their height positions to adjust the supply air cross section, in particular configured as eccentric pins, so that the flame appearance can be varied. The outer casing can also be wavy or stepped at the lower end so that the air gap can be regulated by rotation about the vertical axis. Also possible are perforated discs in horizontal alignment or perforated rings that can be rotated against each other in order to regulate the supply air or to smother the fire in the fire column when the slots provided therein are closed.

BRIEF DESCRIPTION OF THE SEVERAL VIEWS OF THE DRAWINGS

These and other features and advantages of the present invention will become more readily appreciated when considered in connection with the following detailed description and appended drawings, wherein.

DETAILED DESCRIPTION OF THE INVENTION

Figure 1:
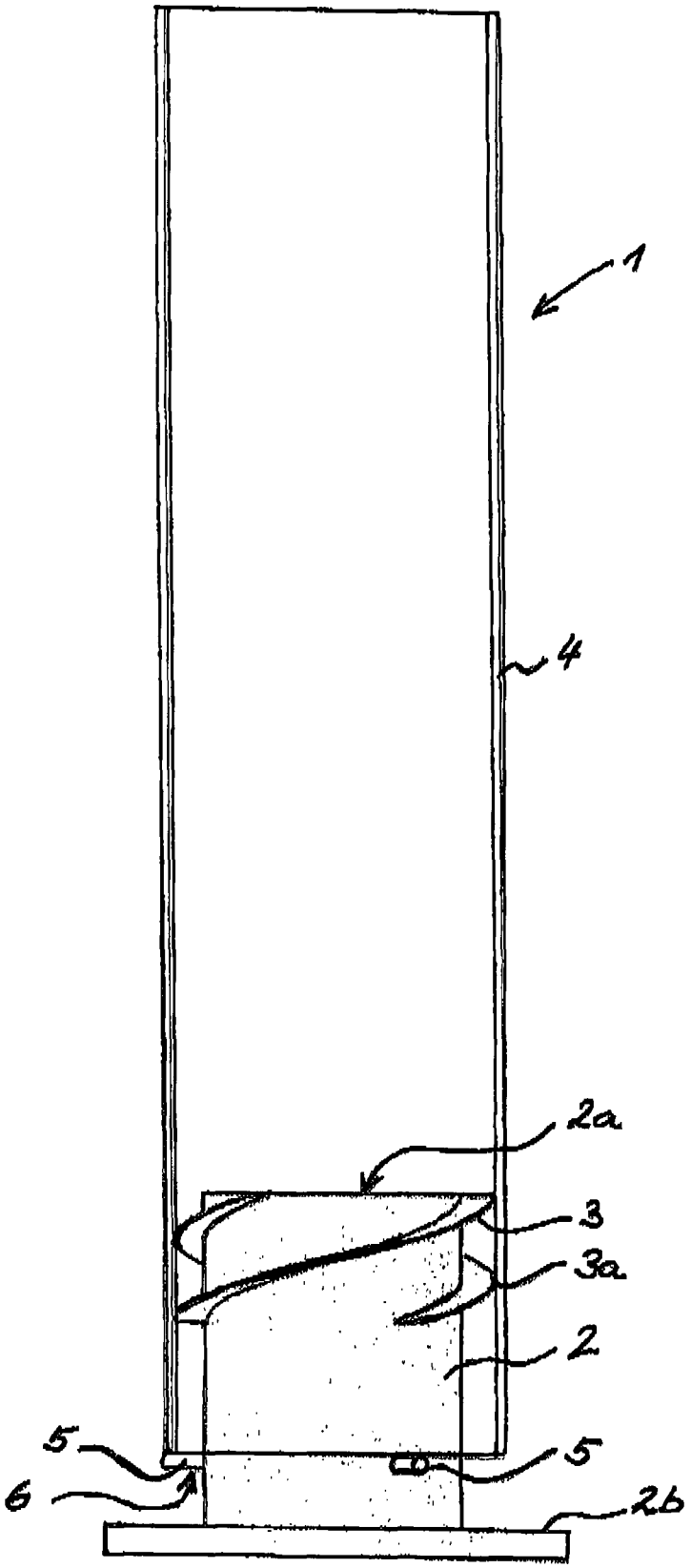
FIG. 1 a fire column in section.

FIG. 1 shows a fire column 1 with a base part 2 that comprises a fuel container 2*a* and a stand plate 2*b*. A number of guide elements 3 are arranged on the base part 2, which are configured here as helical metal sheets in order to create an air vortex in an outer casing 4 placed over them. The latter is preferably designed as a transparent glass cylinder and thus provides a view of the base part 2. The flame enclosed on the circumference by the outer casing 4 is fed by fuel (of any consistency possible), in particular bioethanol or fuel paste from the (recessed) fuel container 2*a* and receives the required amount of air via a supply air opening 6 (in the form of an annular gap) in the lower region of the fire column 1, more precisely at the open lower end face of the outer casing 4.

The incoming air is deflected by the guide elements 3 to form a vortex or flow with swirl. The amount of air can be varied via the cross-section of the supply air opening 6, whereby the height of pins 5, for example, can be adjusted. In the setting shown here, the cross-section above the stand plate 2*a* corresponds approximately to the passage volume between base part 2 and outer casing 4, wherein the relatively thin guide elements 3 hardly reduce the passage. The outer casing 4, which rests on the pins 5 (here three pins with a pitch of 120° on the circumference of the base part), is placed (slipped) over the guide elements 3 with a tight fit or slight clearance fit and touches them at least at some points.

Figure 2A:
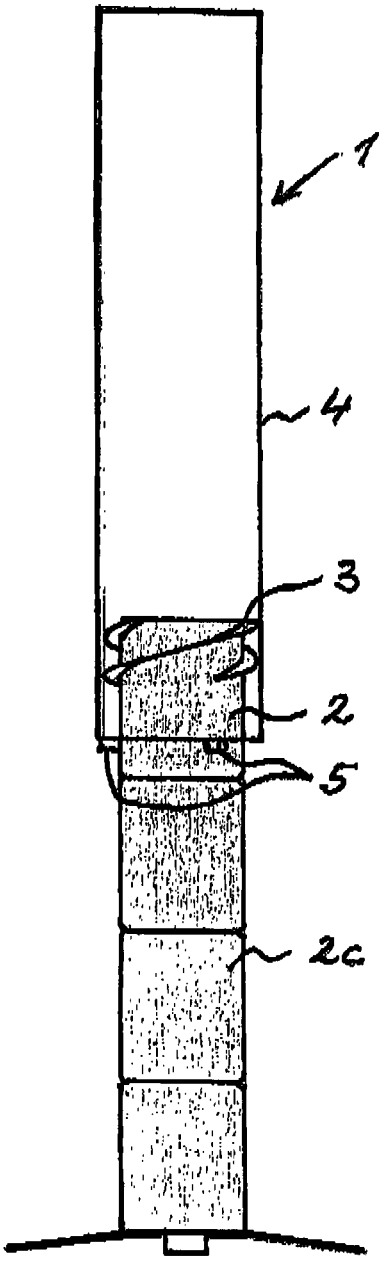
FIGS. 2 (*a*) and (*b*) each a fire column in elevated version.
Figure 2B:
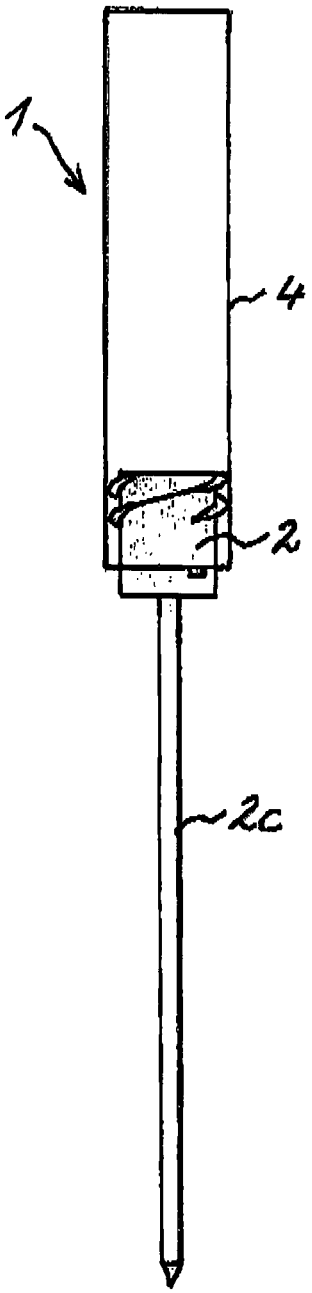

In FIG. 2, the fire column 1 is shown in an elevated version, namely in FIG. 2*a* with a frame-like holder 2*c*, in order to be set up on a terrace, for example. In FIG. 2*b*, the holder 2*c* is rod-like or spike-like, in order to be anchored in the garden ground with this holder in the manner of a ground spike.

Figure 3:
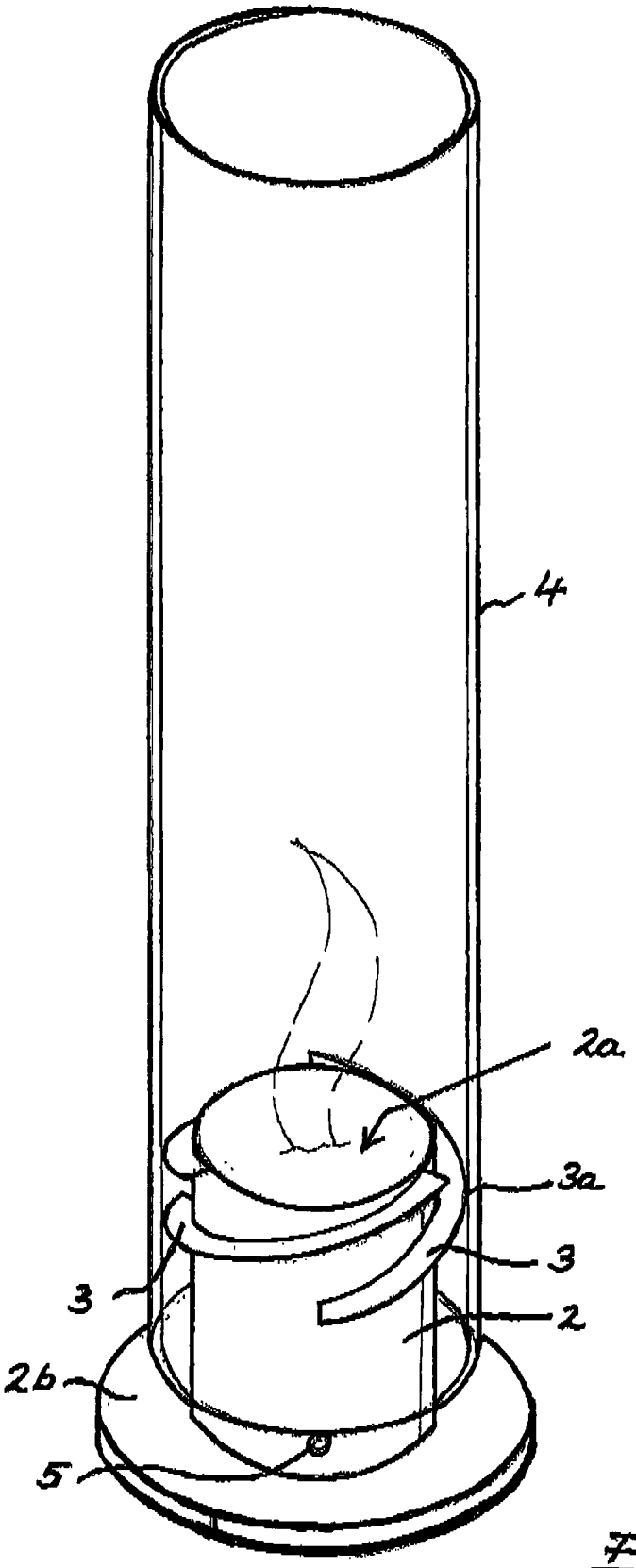
FIG. 3 a fire column according to FIG. 1 in perspective view.

In FIG. 3, the fire column according to FIG. 1 is shown in a perspective view. The helical course of the guide elements 3 is clearly visible, as is the upper opening in the base part 2 to form a fuel container 2*a*. The flame fed from here, indicated schematically, also rises here in a rotating or at least flickering manner in the glass cylinder 4 by the targeted air vortex. The achievable height, e.g. up to ¾ of the outer casing 4, can be adjusted in particular by the burning behavior of the fuel (preferably ethanol) and by the air supply.

Figure 4A:
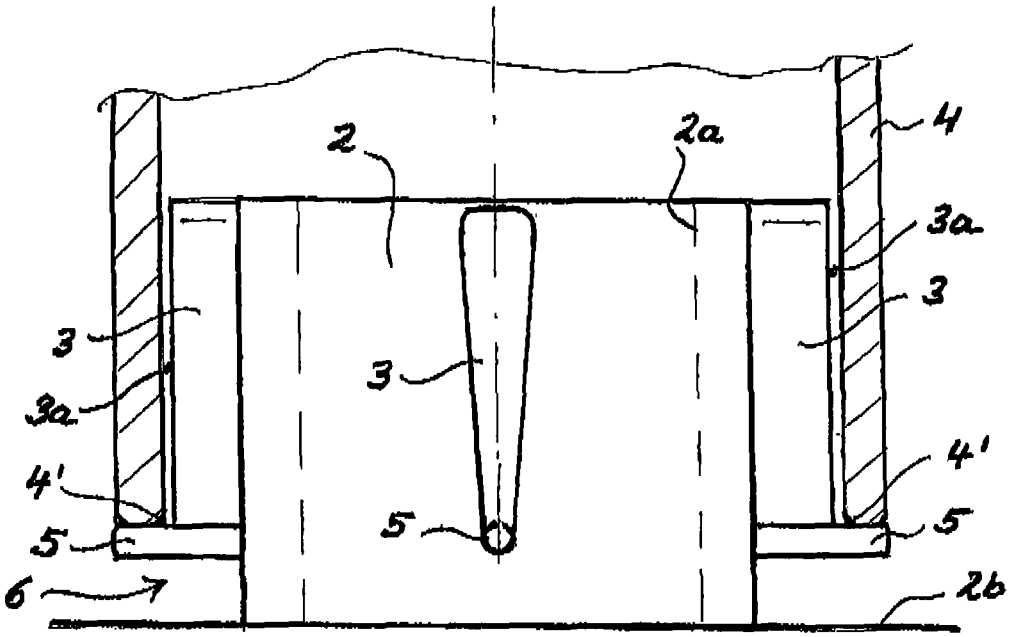
FIGS. 4 (*a*) and (*b*) each a sectional view with different guide elements.

FIG. 4 shows two side views of the base part 2, each of which has four guide elements 3, i.e. with a 90° pitch. The guide elements 3 are aligned here largely in the axial direction (to the vertical axis) and have a shape that widens upward to form four nozzle channels around the circumference of the base part 2 and to accelerate the supply air from the opening 6. In FIG. 4*a*, the outer casing 4 is placed (slipped) over the guide elements 3 with a tight fit so that their outer edges 3*a* almost touch the inner wall of the outer casing. In order to make it easier to slip it over despite this clearance fit, the inner edge 4' is preferably ground conically so that the outer casing 4 can be placed on top in a self-centering manner to be supported on the pins 5 then. Here, the pins 5 are molded onto the lower end of the guide elements 3, in particular cast in one piece.

Figure 4B:
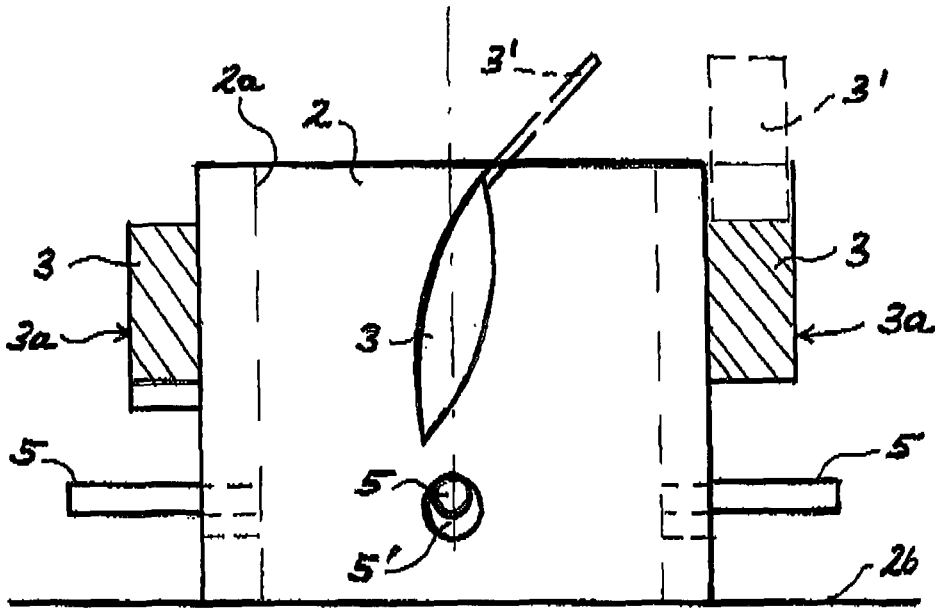

In FIG. 4*b* the guide elements 3 are inclined to the dotted vertical axis and have thin extensions 3' in the form of so-called winglets. These can be glued or soldered onto the guide elements 3 in an easy manner to increase turbulence. The pins 5 are attached to the base part separately from the guide elements 3, preferably by means of eccentric bushings 5', in order to vary the height position of the glass cylinder 4 and the supply air cross section relative to the stand plate 2*a*.

Figure 5A:
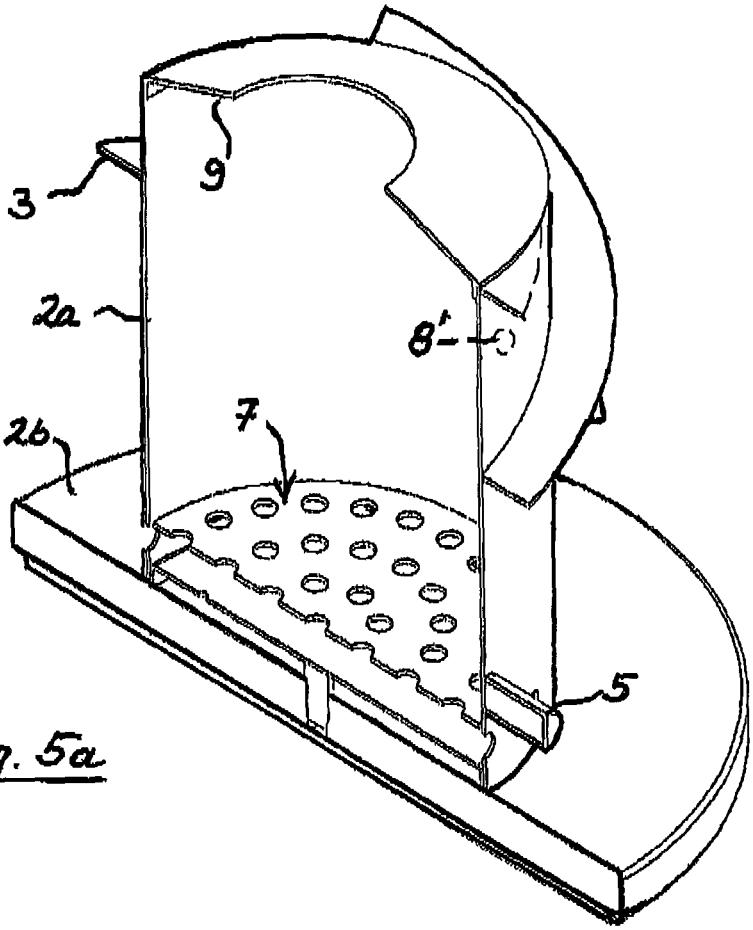
FIGS. 5 (*a*) and (*b*) each an embodiment of a fuel container for pellets.
Figure 5B:
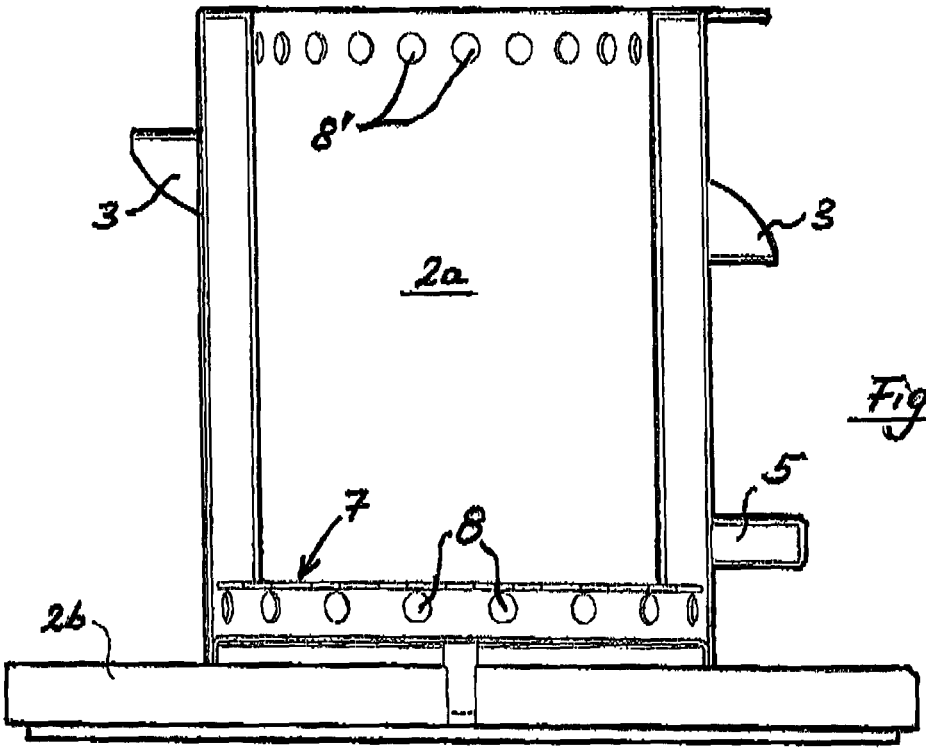

In FIG. 5*a*, the fire column is designed for the combustion of wood pellets, wherein the principle of the wood gasifier is applied. For this purpose, a perforated plate 7 is inserted in the lower region of the fuel container 2*a*, under which several supply air openings 8 (here in the form of perforations or slots) are provided. Through this, primary air flows still below the pins 5 into the fuel container 2*a* and through the pellets piled up on the perforated plate 7 (not shown here, since this commercially available fuel is common for the operation of pellet stoves). The supply air openings 8 can also be provided in the bottom or stand plate 2*b* so that the pellets in the fuel container 2*a* are flown through evenly and the desired wood gas is formed by carbonization or pyrolysis (substoichiometric partial combustion). This is mixed at the upper end of the fuel container 2*a* with the secondary air swirled via the guide elements 3 and then burns (depending on the air supply) with a lower or higher flame. The air supply can be adjusted here by means of (ring) slides not shown at the supply air openings 8 (or also 6 and/or 8' in FIG. 5*b*).

In order to keep the flame central, the fuel container 2*a* here has a hood or partial cover 9 open in the center, which is shaped in particular like a roof or truncated cone. This may also extend beyond the upper edge of the fuel container 2*a*, as indicated in dashed lines, to allow air supply to the interior, namely via upper supply air openings 8'. These are also provided more distinctly in the configuration according to FIG. 5*b*, namely annularly in the upper region of the fuel container 2*a*, wherein the fuel container 2*a* is preferably double-walled at its circumference. As a result, a partial air flow is directed upward along the circumferential surface and then guided radially inward into the combustion zone. This achieves effective and relatively clean combustion of the pellets, since in particular the hood 9 stabilizes the flame.

In summary, the small number of components achieves a purist design with low manufacturing costs. The stable construction increases safety and simplifies operation. In addition, various designs are also possible for outdoor use, wherein the light output or the heat supply can be varied more according to requirements, especially when wood pellets are used. Likewise, the indoor use as a so-called "table fire" is possible, since bio-ethanol burns largely odorless and soot-free, to which also the swirling of the flame can contribute.

The foregoing invention has been described in accordance with the relevant legal standards, thus the description is exemplary rather than limiting in nature. Variations and modifications to the disclosed embodiment may become apparent to those skilled in the art and fall within the scope of the invention.

The invention claimed is:

1. Fire column, the flame of which is fed by a fuel container, the fire column includes a cylindrical base part, the cylindrical base part is surrounded by a cylindrical outer casing, the base part has a smaller diameter than the outer casing establishing an annular gap therebetween, wherein supply air flows through the annular gap in largely axially in the lower region of the outer casing via a plurality of guide elements disposed within the annular gap and is set in a helical rotation to form a vortex flame, wherein the outer casing is placed over the guide elements, and wherein the outer casing rests on a plurality of radially extending pins, the pins and the guide elements are attached directly to the base part.

2. Fire column according to claim 1, characterized in that the outer casing is centered in upright position by outer edges of the guide elements.

3. Fire column according to claim 1, characterized in that the guide elements surround the fuel container and are attached to it.

4. Fire column according to claim 1, characterized in that the pins are attached to a base part which surrounds the fuel container.

5. Fire column according to claim 4, characterized in that the base part has a stand plate detachably connected.

6. Fire column according to claim 4, characterized in that the base part is mounted on an elevated holder or support.

7. Fire column according to claim 1, characterized in that the pins are molded or attached to the respective lower end of the guide elements.

8. Fire column according to claim 1, characterized in that the guide elements are integrally molded to the base part as a casting with three guide elements offset by 120°.

9. Fire column according to claim 1, characterized in that the fuel container is provided for receiving wood pellets or fuels.

10. Fire column according to claim 9, characterized in that in the lower region of the fuel container a perforated plate is inserted, under which supply air openings are provided.

11. Fire column according to claim 9, characterized in that the fuel container has a partial cover which is open in the center and is shaped like a roof or a truncated cone.

12. Fire column according to claim 9, characterized in that further supply air openings are provided in the upper region of the fuel container, wherein the fuel container is of double-walled construction at its circumference.

13. Fire column according to claim 1, characterized in that the pins are adjustable in their height position.

14. Fire column according to claim 1, characterized in that the outer casing is formed as a one-piece glass cylinder as a mesh.

15. Fire column according to claim 14, characterized in that the lower inner edge of the outer casing is conically ground and/or fused on.

16. A fire column assembly, the flame of which is fed by a supply of fuel from an integrated fuel container, said assembly comprising:

a tubular outer casing, the outer casing having an open bottom and an open top, the bottom having an inside diameter, the outer casing adapted to ensconce a live flame while aspirating ambient air through the bottom and exhausting hot combustion gases through the top, a stand plate, a generally cylindrical fuel container extending upwardly from the stand plate, the fuel container having an upper end comprising a fuel outlet elevated above the stand plate, a portion of the fuel container extending through the bottom of the outer casing and generally centered therewith, at least one helical guide element directly attached to the fuel container, the guide element configured to induce a rotational vortex in the live flame, the guide element having a crest height measured radially from the fuel container such that a major diameter of the guide element is smaller than the inside diameter of the outer casing adjacent the bottom thereby enabling the guide element to fit inside the outer casing, the guide element having a start adjacent the stand plate and an end adjacent the upper end of the fuel container, a plurality of support extensions projecting from the cylindrical housing of the fuel container, each support extension having a radial projection greater than the crest height of the guide element, the plurality of support extensions being axially aligned with one another, and wherein the plurality of support extensions are spaced above the stand plate so that the bottom of the outer casing is stationed above the stand plate thereby creating an annular draft intake clearance between the fuel container and the bottom of the outer casing through which ambient air is aspirated directly into the outer casing.

17. Fire column according to claim 16, wherein the support extensions are disposed between the stand plate and the start of the guide element so that the outer casing entirely overlaps the start of the guide element, and wherein the outer casing is a unitary member fabricated from an optically transparent material.

18. A fire column assembly configured to produce a live flame set in rotational vortex, said assembly comprising:

an elongated vertically-oriented tubular outer casing having a uniform wall thickness, the outer casing being a unitary member fabricated from an optically transparent material, the outer casing having an open bottom and an open top, the bottom having an inside diameter, the outer casing adapted to encase a live flame while aspirating ambient air through the bottom and exhausting hot combustion gases through the top, a stand plate, a generally cylindrical fuel container extending upwardly from the stand plate, the fuel container having an upper end comprising a fuel outlet elevated above the stand plate, a portion of the fuel container extending through the bottom of the outer casing and generally centered therewith, a plurality of helical guide elements directly attached to the fuel container, the plurality of guide elements having a common crest height measured radially from the fuel container such that a major diameter of the guide elements is smaller than the inside diameter of the outer casing adjacent the bottom, each guide element having a start adjacent the stand plate and an end adjacent the upper end of the fuel container, a plurality of support extensions projecting from the cylindrical housing of the fuel container, each support extension having a radial projection greater than the crest height of the guide elements, the plurality of support extensions being axially aligned with one another, and wherein the start of each guide element is located above the support extensions so that the outer casing entirely overlaps the start of each guide element.

19. Fire column according to claim 18 wherein the plurality of support extensions are disposed above the stand plate so that the bottom of the outer casing is stationed above the stand plate thereby creating an annular draft intake clearance between the fuel container and the bottom of the outer casing through which ambient air is aspirated directly into the outer casing.

* * * * *